US009546635B2

(12) United States Patent
Bauerle

(10) Patent No.: US 9,546,635 B2
(45) Date of Patent: Jan. 17, 2017

(54) REMOTE START CONTROL FOR VEHICLES

(71) Applicant: GM GLOBAL TECHNOLOGY OPERATIONS LLC, Detroit, MI (US)

(72) Inventor: Paul A. Bauerle, Fenton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 128 days.

(21) Appl. No.: 14/461,280

(22) Filed: Aug. 15, 2014

(65) Prior Publication Data

US 2016/0047348 A1 Feb. 18, 2016

(51) Int. Cl.
*F02N 11/08* (2006.01)

(52) U.S. Cl.
CPC ..... *F02N 11/0848* (2013.01); *F02N 11/0807* (2013.01)

(58) Field of Classification Search
CPC ..... F02N 11/0848; F02N 11/0807
USPC ..... 123/179.2
See application file for complete search history.

(56) References Cited

U.S. PATENT DOCUMENTS 7,474,943 B2 * 1/2009 Matsubara ..... F02D 41/064 123/179.2
8,258,948 B2 * 9/2012 Flick ..... F02N 11/0807 307/10.3
8,313,039 B2 * 11/2012 Flick ..... B60H 1/00385 236/51
8,410,929 B2 * 4/2013 Flick ..... F02N 11/0807 340/10.3
8,534,253 B2 * 9/2013 Matsubara ..... B60R 25/00 123/179.2
2008/0068208 A1 * 3/2008 Hanselman ..... G08C 17/02 340/13.24
2009/0251284 A1 * 10/2009 Wilson ..... F02N 11/103 340/5.64
2011/0073059 A1 * 3/2011 Flick ..... F02N 11/0807 123/179.2

* cited by examiner

*Primary Examiner* — Joseph Dallo
(74) *Attorney, Agent, or Firm* — Lorenz & Kopf, LLP

(57) ABSTRACT

Methods and systems are provided for controlling a remote start feature of an engine of a vehicle. A receiver is configured to receive a signal to initiate a remote start of the engine. A processor is coupled to the receiver, and is configured to initiate the remote start after receiving the signal; set a timer that measures an amount of time after which the remote start has been initiated, for a duration of the remote start; extend the remote start upon detection of an action by an individual proximate the vehicle before the amount of time exceeds a first predetermined threshold; and terminate the remote start after the amount of time exceeds the first predetermined threshold if no action has been detected during the duration of the remote start.

20 Claims, 3 Drawing Sheets

REMOTE START CONTROL FOR VEHICLES

TECHNICAL FIELD

The present disclosure generally relates to the field of vehicles and, more specifically, to methods and systems for controlling remote start functionality for engines of vehicles, such as automobiles.

BACKGROUND

Certain vehicles today having include remote start systems and algorithms that enable a user of the vehicle to remotely start an engine of the vehicle. Such a remote start of the engine may be desired, for example, if the user wishes to have the vehicle's interior heated or cooled before the user enters the vehicle. However, in certain situations, existing remote start systems may not always remain active for an optimal amount of time, for example in light of different circumstances for various remote start events.

Accordingly, it is desirable to provide improved methods and systems for controlling remote start functionality of vehicles, for example with respect to the duration of time for which the remote start remains active. Furthermore, other desirable features and characteristics of the present invention will be apparent from the subsequent detailed description and the appended claims, taken in conjunction with the accompanying drawings and the foregoing technical field and background.

SUMMARY

In accordance with an exemplary embodiment, a method for controlling a remote start feature of an engine of a vehicle is provided. The method comprises setting, via a processor, a timer that measures an amount of time after which a remote start of the engine has been initiated, for a duration of the remote start; extending, via the processor, the remote start upon detection of an action by an individual proximate the vehicle before the amount of time exceeds a first predetermined threshold; and terminating, via the processor, the remote start after the amount of time exceeds the first predetermined threshold if no action has been detected during the duration of the remote start.

In accordance with another exemplary embodiment, a system for controlling a remote start feature of an engine of a vehicle is provided. The system comprises a program and a computer readable storage medium. The program is configured to set a timer that measures an amount of time after which a remote start of the engine has been initiated, for a duration of the remote start; extend the remote start upon detection of an action by an individual proximate the vehicle before the amount of time exceeds a first predetermined threshold; and terminate the remote start after the amount of time exceeds the first predetermined threshold if no action has been detected during the duration of the remote start. The non-transitory, computer readable storage medium is configured to store the program.

In accordance with a further exemplary embodiment, a system for controlling a remote start feature of an engine of a vehicle is provided. The system comprises a receiver and a processor. The receiver is configured to receive a signal to initiate a remote start of the engine. The processor is coupled to the receiver, and is configured to initiate the remote start after receiving the signal; set a timer that measures an amount of time after which the remote start has been initiated, for a duration of the remote start; extend the remote start upon detection of an action by an individual proximate the vehicle before the amount of time exceeds a first predetermined threshold; and terminate the remote start after the amount of time exceeds the first predetermined threshold if no action has been detected during the duration of the remote start.

BRIEF DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the disclosure or the application and uses thereof. Furthermore, there is no intention to be bound by any theory presented in the preceding background or the following detailed description.

Figure 1:
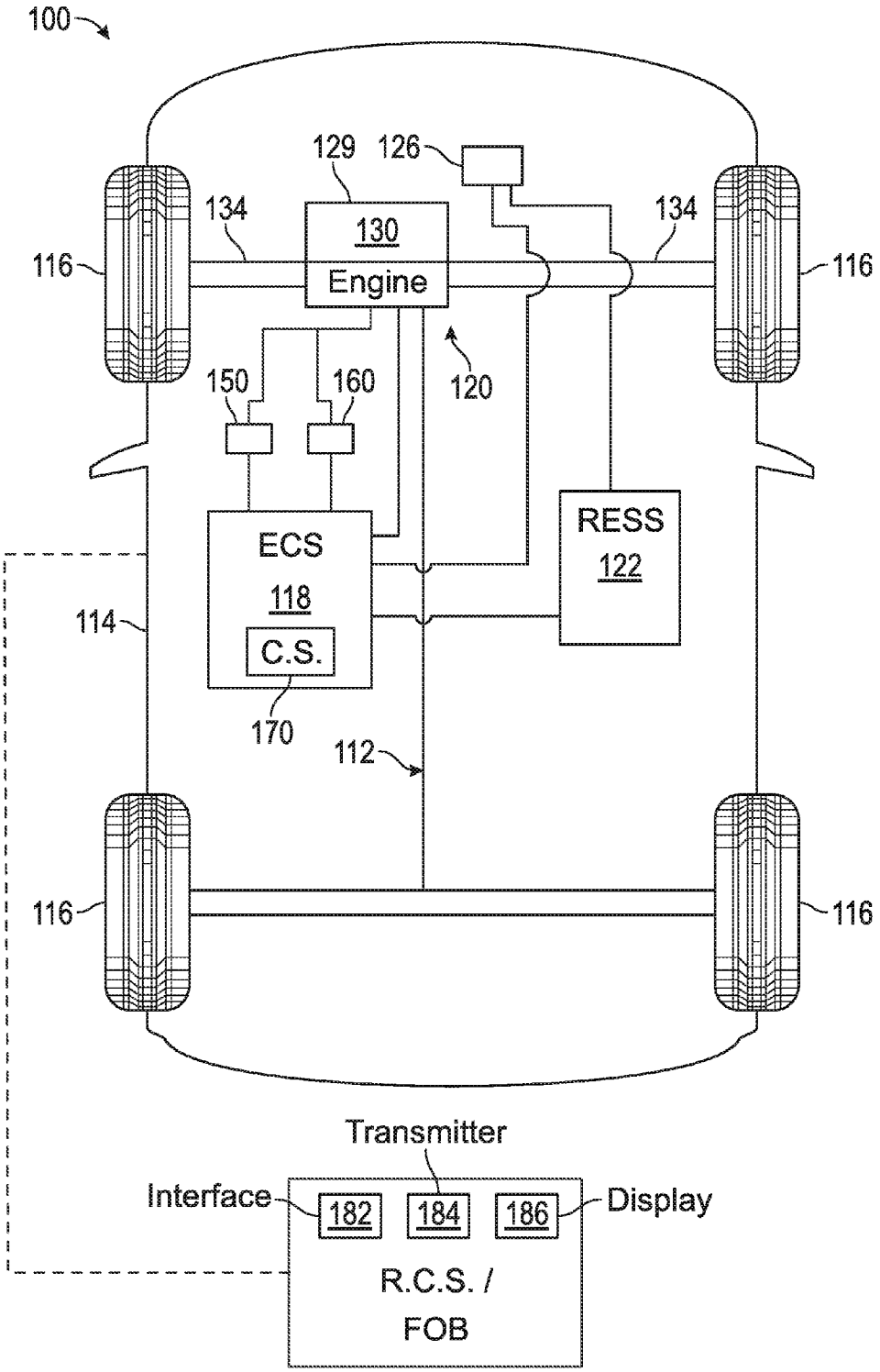
FIG. 1 is a functional block diagram of a vehicle that includes an engine with a remote start feature, and a control system for controlling the remote start feature, and depicted alongside a remote control system for initiating the remote start feature, in accordance with an exemplary embodiment.

FIG. 1 illustrates a vehicle 100, or automobile, according to an exemplary embodiment. The vehicle 100 is also referenced at various points throughout this Application as "the vehicle." As described in greater detail further below, the vehicle 100 includes an engine 130 and a control system 170 for controlling a remote start feature for the engine 130 in accordance with the steps of the process 300 of FIG. 3, described further below.

In FIG. 1, the vehicle 100 is depicted along with a remote control system 180 for remotely starting the engine 130 of the vehicle 100. As depicted in FIG. 1, the remote control system 180 may comprise, among other features, a user interface 182, a transmitter 184, and a display 186. Specifically, in one preferred embodiment, the remote control system 180 comprises a key fob unit or similar device. The remote control system 180 is configured to receive input from a user as to a remote start request and transmit, in response thereto, one or more engine start requests to remotely start the engine 130 of the vehicle 100. Specifically, in one embodiment, when a user engages the user interface 182 to request a remote start of the engine 130, the transmitter 184 transmits a signal to the vehicle 100 to initiate the remote start of the engine 130. The signal is received and implemented by the control system 170 of the vehicle 100, as discussed further below. In one embodiment, the display 186 provides information to the user regarding the remote start of the engine 130.

As depicted in FIG. 1, the vehicle 100 includes a chassis 112, a body 114, four wheels 116, an electronic control system 118, a steering system 150, a braking system 160, and the above-referenced control system 170. The body 114 is arranged on the chassis 112 and substantially encloses the other components of the vehicle 100. The body 114 and the chassis 112 may jointly form a frame. The wheels 116 are each rotationally coupled to the chassis 112 near a respective corner of the body 114.

The vehicle 100 may be any one of a number of different types of automobiles, such as, for example, a sedan, a wagon, a truck, or a sport utility vehicle (SUV), and may be two-wheel drive (2WD) (i.e., rear-wheel drive or front-wheel drive), four-wheel drive (4WD) or all-wheel drive (AWD). The vehicle 100 may also incorporate any one of, or combination of, a number of different types of propulsion systems, such as, for example, a gasoline or diesel fueled combustion engine, a "flex fuel vehicle" (FFV) engine (i.e., using a mixture of gasoline and ethanol), a gaseous compound (e.g., hydrogen or natural gas) fueled engine, a combustion/electric motor hybrid engine, and an electric motor.

The engine 130 has a remote start feature that is controlled by the control system 170 in accordance with the steps of the process 300 described further below in connection with FIG. 3. As mentioned above, the remote start feature may be initiated in accordance with a signal transmitted by the remote control system 180 that is received and implemented by the control system 170 of the vehicle 100. As part of the remote start feature, the control system 170 adjusts the duration of the remote start event as appropriate, for example in situations in which a driver action is detected indicating that the driver may require extra time before operating the vehicle 100, in accordance with the steps of the process 300 discussed further below in connection with FIG. 3.

In one embodiment, the engine 130 comprises a gas combustion engine. In another embodiment, the vehicle 100 may comprise a battery electric vehicle in which the engine 130 comprises an electric motor, the RESS 122 comprises a high voltage vehicle battery that powers the engine 130, and the vehicle 100 further includes a drive system comprising an actuator assembly 120, the above-referenced RESS 122, and a power inverter assembly (or inverter) 126, wherein the actuator assembly 120 includes at least one electric propulsion system 129 mounted on the chassis 112 that includes the engine 130 and drives the wheels 116. As will be appreciated by one skilled in the art, in certain embodiments the engine (or motor) 130 includes a transmission therein, and, although not illustrated, may also include a stator assembly (including conductive coils), a rotor assembly (including a ferromagnetic core), and a cooling fluid or coolant.

Still referring to FIG. 1, the engine 130 is integrated such that it is mechanically coupled to at least some of the wheels 116 through one or more drive shafts 134. As mentioned above, in one embodiment, the vehicle 100 includes a gas combustion engine 130. In another embodiment, the vehicle 100 comprises a battery electric vehicle. In certain other embodiments, the vehicle 100 may comprise a hybrid electric vehicle (HEV) that has a combustion engine along with an electric motor. In such other embodiments, the vehicle 100 may comprise a "series HEV" (in which a combustion engine is not directly coupled to the transmission, but coupled to a generator which is used to power the electric motor 130) or a "parallel HEV" (in which a combustion engine is directly coupled to the transmission by, for example, having the rotor of the electric motor 130 rotationally coupled to the drive shaft of the combustion engine).

In one embodiment, the RESS 122 is mounted on the chassis 112. In one embodiment, the RESS 122 comprises a battery having a pack of battery cells. In one embodiment, the RESS 122 comprises a lithium iron phosphate battery, such as a nanophosphate lithium ion battery. In one embodiment, the RESS 122 comprises a high voltage battery that, along with an electric propulsion system(s) 129, provide a drive system to propel the vehicle 100 (in one such embodiment, the RESS 122 is also coupled to an inverter 126, as depicted in FIG. 1).

The steering system 150 is mounted on the chassis 112, and controls steering of the wheels 116. The steering system 150 includes a steering wheel and a steering column (not depicted). The steering wheel receives inputs from a driver of the vehicle. The steering column results in desired steering angles for the wheels 116 via the drive shafts 134 based on the inputs from the driver.

The braking system 160 is mounted on the chassis 112, and provides braking for the vehicle 100. The braking system 160 receives inputs from the driver via a brake pedal (not depicted), and provides appropriate braking via brake units (also not depicted). The driver also provides inputs via an accelerator pedal (not depicted) as to a desired speed or acceleration of the vehicle, inputs via a cruise control resume switch (not depicted), and various other inputs for various vehicle devices and/or systems, such as one or more vehicle radios, other entertainment systems, environmental control systems, lightning units, navigation systems, and the like (also not depicted). In one embodiment, the braking system 160 includes both a regenerative braking capability and a friction braking capability for the vehicle 100.

The control system 170 is mounted on the chassis 112, and is coupled to the engine 130. As noted above, the control system 170 controls the remote start feature for the engine 130 in accordance with the steps of the process 300 described further below in connection with FIG. 3. In one embodiment, the control system 170 comprises an engine control module (ECM) for generally controlling the engine 130. In addition, in one embodiment depicted in FIG. 1, the control system 170 is part of the electronic control system (ECS) 118 that also controls one or more operations of other vehicle components such as, by way of example, the inverter 126 (if applicable), the RESS 122, the steering system 150, and the braking system 160.

Figure 2:
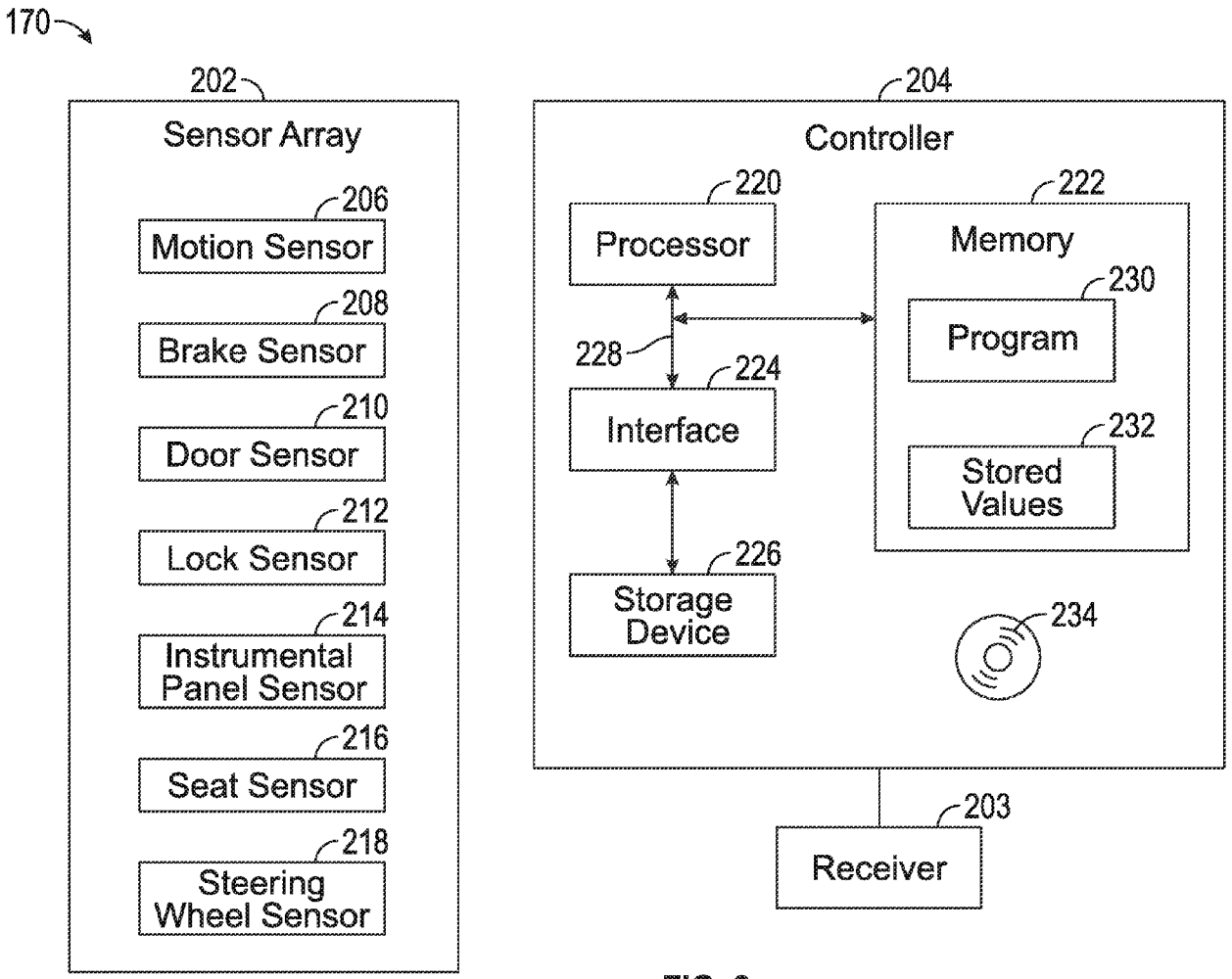
FIG. 2 is a functional block diagram of the control system of FIG. 1, in accordance with an exemplary embodiment.

With reference to FIG. 2, a functional block diagram is provided for the control system 170, in accordance with an exemplary embodiment. As depicted in FIG. 2, the control system 170 includes a sensor array 202, a receiver 203, and a controller 204.

The sensor array 202 measures and obtains information for use by the controller 204 for controlling the remote start feature of the engine 130 of FIG. 1. As depicted in FIG. 2, in one embodiment, the sensor array 202 includes one or more motion sensor 206, brake sensors 208, door sensors 210, lock sensors 212, instrument panel sensors 214, seat sensors 216, and steering wheel sensor 218. It will be appreciated that the types and/or number of sensors in the sensor array 202 may vary in different embodiments.

The motion sensor(s) 206 detect and/or measure movement of a person (e.g. the driver of the vehicle 100) outside the vehicle 100. For example, in certain embodiments, the motion sensor(s) detect when an individual, such as the driver, is approaching the vehicle 100, walking across the vehicle 100, and so on. In various embodiments, the motion sensor(s) comprise one or more cameras, radar sensors, light detection and ranging (LIDAR) and/or other sensors capable of detecting and/or measuring motion. In one embodiment, the motion sensor(s) 206 are detected on or near an exterior of the vehicle 100 (e.g. on or near the front hood, the trunk, the doors, and so on) to detect movement of individuals outside the vehicle 100.

The brake pedal sensor(s) 208 measure values pertaining to an engagement of a brake pedal (e.g., brake pedal force and/or brake pedal travel) of the braking system 160 of FIG. 1 by a driver of the vehicle. In one embodiment, the brake pedal sensor(s) 208 are disposed proximate a brake pedal of the braking system 160 of FIG. 1.

The door sensor(s) 210 detect and/or measure values pertaining to an engagement of a door of the vehicle 100, for example by a driver or passenger of the vehicle 100 about to enter the vehicle 100. In one embodiment, the door sensor(s) 210 are disposed proximate one or more doors of the vehicle 100 (e.g. proximate one or more door handles).

The lock sensor(s) 212 detect and/or measure values pertaining to an engagement of a lock of the vehicle 100 (e.g., a door lock), for example by a driver or passenger of the vehicle 100 about to enter the vehicle 100. In certain one embodiment, the lock sensor(s) 212 are disposed proximate one or more door locks of the vehicle 100 (e.g. proximate a door of the vehicle 100 or an electronic lock switch for the door locks of the vehicle 100).

The instrument panel sensor(s) 214 detect and/or measure values pertaining to an engagement of an instrument panel switch of the vehicle 100 (e.g., an ignition switch, a radio switch, a climate control switch, a navigation device switch, and so on), for example by a driver or passenger of the vehicle 100 about to enter the vehicle 100. In certain one embodiment, the instrument panel sensor(s) 214 are disposed proximate an instrument panel of the vehicle 100.

The seat sensor(s) 216 detect and/or measure values pertaining to an engagement of a seat occupied switch of the vehicle 100, for example by a driver or passenger of the vehicle 100 sitting down on a seat of the vehicle 100. In certain one embodiment, the seat sensor(s) 216 are disposed proximate one or more seats of the vehicle (e.g., the driver's seat or the front passenger's seat).

The steering wheel sensor(s) 218 detect and/or measure values pertaining to an engagement of a steering wheel of the steering system 150 of FIG. 1. In certain one embodiment, the steering wheel sensor(s) 218 are disposed proximate the steering wheel.

As noted above, the specific number and/or type(s) of the sensors of the sensor array 202 may vary in different embodiments. For example, in various embodiments, any number of the same and/or different types of sensors may be used to detect a user action within or proximate the vehicle 100 of FIG. 1.

As noted above, the specific number and/or type(s) of the sensors of the sensor array 202 may vary in different embodiments. For example, in various embodiments, any number of the same and/or different types of sensors may be used to detect a user action within or proximate the vehicle 100 of FIG. 1. Regardless of the type(s) of sensors, in one embodiment the sensor array 202 provides information as to a detection and/or measurement of user action within or proximate the vehicle to the controller 204 for use in controlling the remote start feature for the engine 130 of the vehicle 100 of FIG. 1.

The receiver 203 receives signals from the remote control system 180 of FIG. 1 with the user's request for a remote start of the engine 130 of the vehicle 100 of FIG. 1. In certain embodiments, the receiver 203 may also receive subsequent signals from remote control system 180 of FIG. 1, for example indicating that whether the user has remained in proximity to the vehicle 100 and/or has provided any additional inputs. In one embodiment, the receiver 203 provides this information to the controller 204 for initiating and controlling the remote start event.

The controller 204 is coupled to the sensor array 202 and to the receiver 203. The controller 204 initiates and controls the remote start feature for the engine 130 of FIG. 1 based on the information provided by the sensor array 202 and the receiver 203, in accordance with the steps of the process 300 depicted in FIG. 3 and described below in connection therewith.

As depicted in FIG. 2, the controller 204 comprises a computer system. In certain embodiments, the controller 204 may also include one or more of the sensors of the sensor array 202. In addition, it will be appreciated that the controller 204 may otherwise differ from the embodiment depicted in FIG. 2. For example, the controller 204 may be coupled to or may otherwise utilize one or more remote computer systems and/or other control systems.

In the depicted embodiment, the computer system of the controller 204 includes a processor 220, a memory 222, an interface 224, a storage device 226, and a bus 228. The processor 220 performs the computation and control functions of the controller 204, and may comprise any type of processor or multiple processors, single integrated circuits such as a microprocessor, or any suitable number of integrated circuit devices and/or circuit boards working in cooperation to accomplish the functions of a processing unit. During operation, the processor 220 executes one or more programs 230 contained within the memory 222 and, as such, controls the general operation of the controller 204 and the computer system of the controller 204, preferably in executing the steps of the processes described herein, such as the steps of the process 300 (and any sub-processes thereof) in connection with FIG. 3.

The memory 222 can be any type of suitable memory. In various embodiments, this may include the various types of dynamic random access memory (DRAM) such as SDRAM, the various types of static RAM (SRAM), and the various types of non-volatile memory (PROM, EPROM, and flash). In certain examples, the memory 222 is located on and/or co-located on the same computer chip as the processor 220. In the depicted embodiment, the memory 222 stores the above-referenced program 230 along with one or more stored values 232 (e.g., threshold values) for use in implementing the measurements from the sensor array 202.

The bus 228 serves to transmit programs, data, status and other information or signals between the various components of the computer system of the controller 204. The interface 224 allows communication to the computer system of the controller 204, for example from a system driver and/or another computer system, and can be implemented using any suitable method and apparatus. It can include one or more network interfaces to communicate with other systems or components. The interface 224 may also include one or more network interfaces to communicate with technicians, and/or one or more storage interfaces to connect to storage apparatuses, such as the storage device 226.

The storage device 226 can be any suitable type of storage apparatus, including direct access storage devices such as hard disk drives, flash systems, floppy disk drives and optical disk drives. In one exemplary embodiment, the storage device 226 comprises a program product from which memory 222 can receive a program 230 that executes one or more embodiments of one or more processes of the present disclosure, such as the steps of the process 300 (and any sub-processes thereof) of FIG. 3, described further below. In another exemplary embodiment, the program product may be directly stored in and/or otherwise accessed by the memory 222 and/or a disk (e.g., disk 234), such as that referenced below.

The bus 228 can be any suitable physical or logical means of connecting computer systems and components. This includes, but is not limited to, direct hard-wired connections, fiber optics, infrared and wireless bus technologies. During operation, the program 230 is stored in the memory 222 and executed by the processor 220.

It will be appreciated that while this exemplary embodiment is described in the context of a fully functioning computer system, those skilled in the art will recognize that the mechanisms of the present disclosure are capable of being distributed as a program product with one or more types of non-transitory computer-readable signal bearing media used to store the program and the instructions thereof and carry out the distribution thereof, such as a non-transitory computer readable medium bearing the program and containing computer instructions stored therein for causing a computer processor (such as the processor 220) to perform and execute the program. Such a program product may take a variety of forms, and the present disclosure applies equally regardless of the particular type of computer-readable signal bearing media used to carry out the distribution. Examples of signal bearing media include: recordable media such as floppy disks, hard drives, memory cards and optical disks, and transmission media such as digital and analog communication links. It will similarly be appreciated that the computer system of the controller 204 may also otherwise differ from the embodiment depicted in FIG. 2, for example in that the computer system of the controller 204 may be coupled to or may otherwise utilize one or more remote computer systems and/or other control systems.

Figure 3:
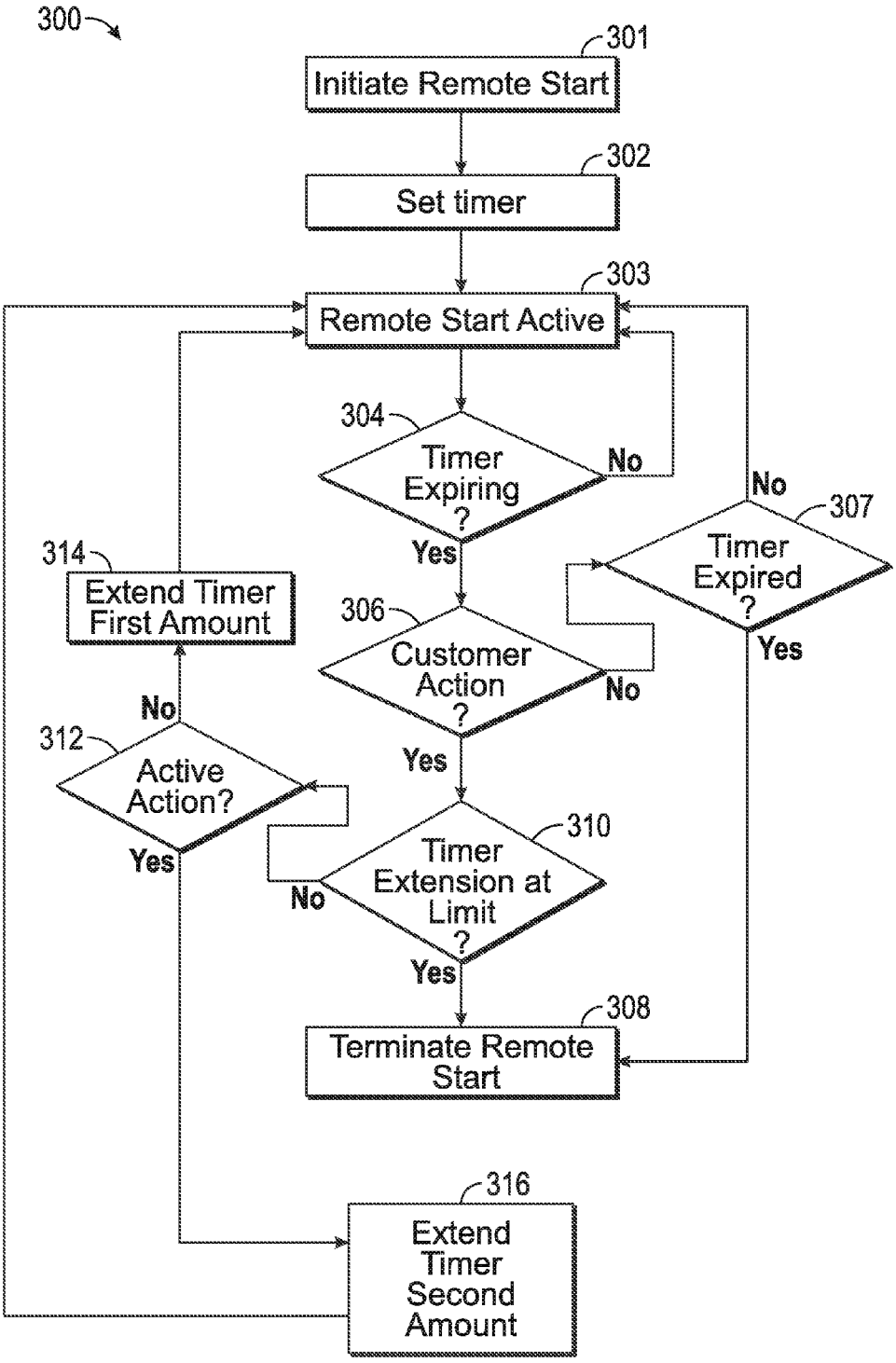
FIG. 3 is a flowchart of a process for controlling a remote start feature of a vehicle, and that can be used in conjunction with the vehicle of FIG. 1 and the engine and control system of FIGS. 1 and 2, in accordance with an exemplary embodiment.

FIG. 3 is a flowchart of a process 300 for controlling a remote start feature for a vehicle, in accordance with an exemplary embodiment. The process 300 can be used in connection with the vehicle 100 of FIG. 1 and the engine 130 and the control system 170 of FIGS. 1 and 2, in accordance with an exemplary embodiment.

As depicted in FIG. 3, in one embodiment the process 300 begins once a remote start for the engine 130 of FIG. 1 is initiated (step 301). In one embodiment, this occurs when the receiver 203 of FIG. 2 receives a signal of from the remote control system 180 of FIG. 1 requesting an engine remote start, and the processor 220 of FIG. 2 implements the request by initiating the remote start of the engine 130.

Once the remote start is initiated, a timer is set (step 302). In one embodiment, the timer measures an amount of time after which a remote start of the engine has been initiated, and remains active for a duration of the remote start. Also in one embodiment, the timer is set and maintained by the processor 220 of FIG. 2. The remote start remains active (step 303) as the time continues, until a subsequent determination that the timer has expired, as described below.

A determination is made as to whether the timer of step 302 is expiring expired (step 304). Specifically, in one embodiment, a determination is made in step 304 as to whether the amount of time after the initiation of the remote start is approaching a first predetermined threshold (e.g., as to whether the amount of time is within ten percent of the first predetermined threshold in one example, although this may vary). In one embodiment, the determination is whether the timer is approximately expired (e.g. as to whether there is only a relatively small amount of time, such as a matter of seconds, before the timer is about to expire). In one embodiment, the first predetermined threshold is equal to approximately ten minutes, and the timer may be considered to be expiring in step 304 when the amount of time is greater than nine minutes by way of example only; however, these values may vary in other embodiments. Also in one embodiment, this determination is made by the processor 220 of FIG. 2.

If a determination is made in step 304 that the timer is not expiring, then the process returns to step 303. The remote start then remains active until a determination is made in a subsequent iteration of step 304 that the timer has expired (or, in some embodiments, that the timer is approximately expired).

Once a determination is made in an iteration of step 304 that the timer has expired (or, in some embodiments, that the timer is approximately expired), then a determination is made as to whether an action is detected by an individual in proximity to the vehicle (step 306). In various embodiments, this determination is made by the processor 220 of FIG. 2 based on information received by one or both of the receiver 203 and/or the sensor array 202 of FIG. 2.

In certain embodiments, the determination of step 306 includes a determination as to whether an individual in proximity to the vehicle is moving with respect to the vehicle. In certain of these embodiments, the determination of step 306 comprises a determination as to whether there has been a detection of a movement of an individual in proximity to the vehicle is moving from one side of the vehicle to another, opposing side of the vehicle (e.g., from the driver side of the vehicle to the passenger side of the vehicle or vice versa, or from the front of the vehicle to the rear of the vehicle or vices versa). For example, such movement would include a user moving about the vehicle to clean or de-ice the windshield and/or windows of the vehicle, to place children into their car seats, to place luggage in the vehicle, or for the user himself to enter the vehicle, and so on. In certain embodiments, the movement of the individual is detected by signals transmitted by the user's remote control system 180 of FIG. 1 and received by the receiver 203 of FIG. 2 of the vehicle 100. In certain other embodiments, the movement of the individual is detected by one or more motion sensor 206 of FIG. 2.

In certain embodiments, the determination of step 306 also includes a determination as to whether an individual in proximity to the vehicle has engaged any apparatus of the vehicle 100. For example, in certain embodiments, the determination of step 306 comprises a determination as to whether there has been a detection of an engagement of a door and/or lock (e.g., a manual and/or electronic door lock) of the vehicle 100 by an individual (e.g. through manual contact and/or through the remote control system 180 of FIG. 1), as detected by the door sensor(s) 210 and/or the lock sensor(s) 212 of FIG. 2. In addition, in certain embodiments, the determination of step 306 comprises a determination as to whether there has been a detection of an engagement of an apparatus of the vehicle from a user that is disposed inside the vehicle, for example through a user's engagement of a brake pedal of the braking system 160 of FIG. 1, as detected by the brake pedal sensor(s) 208 of FIG. 2; one or more instrument panel buttons or switches on or proximate an instrument panel of the vehicle 100 (e.g. for a radio, ignition, climate control system, navigation unit, or the like), as detected by the instrument panel sensor(s) 214 of FIG. 2; a seat of the vehicle 100, as detected by the seat sensor(s) 216 of FIG. 2; and/or a steering wheel of the steering system 150 of the vehicle 100, as detected by the steering wheel sensor(s) 218 of FIG. 2, among other possible vehicle apparatus.

If it is determined in step 306 that an action has not been detected by an individual in proximity to the vehicle prior to the expiration of the timer of step 302 (i.e., while the amount of time after the initiation of the remote start has not exceeded the first predetermined threshold of step 304), then a determination is made as to whether the timer has expired (step 307). In one embodiment, the timer is considered to be expired in step 307 if the amount of time for the remote start event has exceeded the first predetermined threshold mentioned above in step 304 (e.g., ten minutes in the above-described example, although this value may vary in different embodiments). Also in one embodiment, this determination is made by the processor 220 of FIG. 2. If it is determined in step 307 that the timer has expired, then the remote start terminates (step 308). Specifically, during step 308, the engine 130 of the vehicle 100 of FIG. 1 is automatically turned off, as the remote start event terminates. In one embodiment, the remote start terminates in step 308 based on instructions provided by the processor 220 of FIG. 2. Conversely, if it is determined in step 307 that the timer has not expired, the process returns to the above-described step 303.

With reference again to step 306, if it is determined in step 306 that an action has been detected by an individual in proximity to the vehicle prior to the expiration of the timer of step 302 (i.e., while the amount of time after the initiation of the remote start has not exceeded the first predetermined threshold of step 304), then a further determination is made as to whether the timer extension limit has been reached (step 310). In one embodiment, the timer extension limit comprises a maximum, total amount of time for the remote start event, including any extensions of steps 314 and/or 316, discussed further below. Specifically, in one embodiment, the timer extension limit comprises a second predetermined threshold after which the remote start will automatically terminate, regardless of any detection of actions by individuals proximate the vehicle 100. For example, in one embodiment in which the first predetermined threshold of step 304 is equal to 10 minutes, the timer extension limit of step 310 may equal 20 minutes in one particular example; however, this may vary in other embodiments. In one embodiment, the determination of step 310 is made by the processor 220 of FIG. 2.

If it is determined in step 310 that the timer extension limit has been reached, then the process proceeds to the above-referenced step 308, and the remote start terminates.

Conversely, if it is determined in step 310 that the timer extension limit has not been reached, then a determination is made as to whether the detected action of step 306 represents an active action by the individual (step 312). For example, in certain embodiments, an individual's movement with respect to the vehicle would be considered a passive action, while an individual's engagement of a particular vehicle apparatus (e.g. a door, a lock, a brake pedal, an instrument panel button or switch, a seat, and/or a steering wheel) would be considered an active action. In one embodiment, this determination is made by the processor 220 of FIG. 2 based on information provided by the receiver 203 and/or the sensor array 202 of FIG.

If it is determined in step 312 that the action represents a passive action by the individual, then the timer is incremented by a first extension amount (step 314). Specifically, in one embodiment, during step 314, the remote start of the engine 130 is extended by a first extension amount upon detection of the passive action by the individual. The process returns to step 303, as the remote start continues with the timer extension.

In one embodiment, step 314 is performed by the processor 220 of FIG. 2. By way of illustration only, in one embodiment the first extension amount may be equal to approximately two minutes; however, this may vary in different embodiments. Also in one embodiment, the remote start is extended only up until the timer extension limit of step 310 is met. By way of illustration only, in one example if the timer extension limit is twenty minutes and the remote start event has been underway for nineteen minutes, then the remote start extension of step 314 would only last for one additional minute until the remote start would be terminated, regardless of whether the extension of step 314 would otherwise call for an extension of greater than one minute.

Conversely, if it is determined in step 312 that the action represents an active action by the individual, then the timer is incremented by a second extension amount (step 316). Specifically, in one embodiment, during step 316, the remote start of the engine 130 is extended by a second extension amount upon detection of the active action by the individual. The process returns to step 303, as the remote start continues with the timer extension.

In one embodiment, step 316 is performed by the processor 220 of FIG. 2. Also in one embodiment, the second extension amount of step 316 (for active actions) is greater than the first extension amount of step 314 (for passive actions). By way of illustration only, in one embodiment the second extension amount of step 316 may be equal to approximately five minutes; however, this may vary in different embodiments. Also in one embodiment, the remote start is extended in step 316 only up until the timer extension limit of step 310 is met. By way of illustration only, in one example if the timer extension limit is twenty minutes and the remote start event has been underway for seventeen minutes, then the remote start extension of step 316 would only last for three additional minutes until the remote start would be terminated, regardless of whether the extension of step 316 would otherwise call for an extension of greater than three minutes.

Accordingly, methods and systems are provided for controlling a remote start feature for an engine of a vehicle. As discussed above, the provided methods and systems provide for extensions of the remote start event in appropriate circumstances when an action is detected in proximity to the vehicle to indicate that additional time may be needed for the remote start of the engine. Also as described above, in certain embodiments the duration of the extensions may be tailored to the specific types of actions, in differentiating between active and passive actions. The disclosed methods and systems can thus help to avoid any inconvenience that might otherwise occur, for example to help avoid the remote start from terminating just as the user is about to enter and/or operate the vehicle.

It will be appreciated that the vehicle of FIG. 1, and/or the systems of FIGS. 1 and 2, including without limitation the engine 130 and the control system 170, and/or components thereof, may vary in different embodiments. It will also be appreciated that various steps of the process 300 described herein in connection with FIG. 3 may vary in certain embodiments. It will similarly be appreciated that various steps of the process 300 described herein in connection with FIG. 3 may occur simultaneous with one another, and/or in a different order as presented in FIG. 3 and/or as described above.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

I claim:

1. A method for controlling a remote start feature of an engine of a vehicle, the method comprising:

setting, via a processor, a timer that measures an amount of time after which a remote start of the engine has been initiated, for a duration of the remote start;

extending, via the processor, the remote start upon detection of an action by an individual proximate the vehicle before the amount of time exceeds a first predetermined threshold, wherein the step of extending the remote start comprises:

extending the remote start by a first extension amount upon detection of a passive action by the individual; and extending the remote start by a second extension amount upon detection of an active action by the individual, wherein the second extension amount is greater than the first extension amount; and terminating, via the processor, the remote start after the amount of time exceeds the first predetermined threshold if no action has been detected during the duration of the remote start.

2. The method of claim 1, further comprising:

terminating the remote start when the amount of time exceeds a second predetermined threshold, the second predetermined threshold being greater than the first predetermined threshold, regardless of whether the action has been detected.

3. The method of claim 1, further comprising:

detecting the action, wherein the action comprises an engagement of a door of the vehicle.

4. The method of claim 1, further comprising:

detecting the action, wherein the action comprises an engagement of a lock of the vehicle.

5. The method of claim 1, further comprising:

detecting the action, wherein the action comprises an engagement of an apparatus of the vehicle from inside the vehicle.

6. A program product for controlling a remote start feature of an engine of a vehicle, the program product comprising:

a program configured to:

set a timer that measures an amount of time after which a remote start of the engine has been initiated, for a duration of the remote start;

extend the remote start upon detection of an action by an individual proximate the vehicle before the amount of time exceeds a first predetermined threshold, wherein the remote start is extended:

by a first extension amount upon detection of a passive action by the individual; and by a second extension amount upon detection of an active action by the individual, wherein the second extension amount is greater than the first extension amount; and terminate the remote start after the amount of time exceeds the first predetermined threshold if no action has been detected during the duration of the remote start; and a non-transitory, computer readable storage medium configured to store the program.

7. The program product of claim 6, wherein the program is configured to terminate the remote start when the amount of time exceeds a second predetermined threshold, the second predetermined threshold being greater than the first predetermined threshold, regardless of whether the action has been detected.

8. The program product of claim 6, wherein the action comprises an engagement of an apparatus of the vehicle from inside the vehicle.

9. A system for controlling a remote start feature of an engine of a vehicle, the system comprising:

a receiver configured to receive a signal to initiate a remote start of the engine; and a processor coupled to the receiver, the processor configured to:

initiate the remote start after receiving the signal;

set a timer that measures an amount of time after which the remote start has been initiated, for a duration of the remote start;

extend the remote start upon detection of an action by an individual proximate the vehicle before the amount of time exceeds a first predetermined threshold, wherein the remote start is extended:

by a first extension amount upon detection of a passive action by the individual; and by a second extension amount upon detection of an active action by the individual, wherein the second extension amount is greater than the first extension amount; and terminate the remote start after the amount of time exceeds the first predetermined threshold if no action has been detected during the duration of the remote start.

10. The system of claim 9, wherein the processor is configured to terminate the remote start when the amount of time exceeds a second predetermined threshold, the second predetermined threshold being greater than the first predetermined threshold, regardless of whether the action has been detected.

11. The system of claim 9, wherein:

the receiver is configured to receive additional signals representative of a movement by the individual with respect to the vehicle; and the processor is configured to extend the remote start upon detection of the movement by the individual with respect to the vehicle before the amount of time exceeds the first predetermined threshold.

12. The system of claim 9, further comprising:

a sensor configured to detect movement by the individual with respect to the vehicle;

wherein the processor is configured to extend the remote start upon the detection of the movement by the individual with respect to the vehicle before the amount of time exceeds the first predetermined threshold.

13. The system of claim 9, further comprising:

a sensor configured to detect engagement of a door, a lock, or both of the vehicle;

wherein the processor is configured to extend the remote start upon the detection of the engagement of the door of the vehicle before the amount of time exceeds the first predetermined threshold.

14. The system of claim 9, further comprising:

a sensor configured to detect engagement of an apparatus of the vehicle from inside the vehicle;

wherein the processor is configured to extend the remote start upon the detection of the engagement of the apparatus of the vehicle from inside the vehicle before the amount of time exceeds the first predetermined threshold.

15. The method of claim 1, wherein the step of extending the remote start comprises:

extending the remote start by the first extension amount upon detection of a passive action by the individual, wherein the passive action comprises a movement by the individual with respect to the vehicle; and extending the remote start by the second extension amount, greater than the first extension amount, upon detection of an active action by the individual, wherein the active action comprises the individual's engagement of a particular vehicle apparatus.

16. The program product of claim 6, wherein the program is configured to:

extend the remote start by the first extension amount upon detection of a passive action comprising movement by the individual with respect to the vehicle; and extend the remote start by the second extension amount, greater than the first extension amount, upon detection of an active action comprising the individual's engagement of a particular vehicle apparatus.

17. The system of claim 9, wherein the processor is configured to:

extend the remote start by the first extension amount upon detection of a passive action comprising movement by the individual with respect to the vehicle; and extend the remote start by the second extension amount, greater than the first extension amount, upon detection of an active action by the individual, wherein the active action comprises the individual's engagement of a particular vehicle apparatus.

18. The system of claim 17, wherein the passive action comprises a walking of the individual in proximity to the vehicle.

19. The method of claim 17, wherein the active action comprises engaging a lock, a door, or both of the vehicle.

20. The system of claim 17, wherein:

the passive action comprises a walking of the individual in proximity to the vehicle; and the active action comprises engaging a lock, a door, or both of the vehicle.

* * * * *